US005511767A

United States Patent [19]

Kikumoto et al.

[11] Patent Number: 5,511,767

[45] Date of Patent: Apr. 30, 1996

[54] COPPER SMELTING APPARATUS

[75] Inventors: Nobuo Kikumoto; Osamu Iida, both of Tokyo, Japan

[73] Assignee: Mitsubishi Materials Corporation, Tokyo, Japan

[21] Appl. No.: 331,888

[22] Filed: Oct. 31, 1994

[30] Foreign Application Priority Data

Jun. 3, 1994 [JP] Japan ..... 6-122887

[51] Int. Cl.[6] ..... C21B 7/00

[52] U.S. Cl. ..... 266/143; 266/186

[58] Field of Search ..... 266/142, 143, 266/171, 186, 195; 75/641, 643, 645, 646

[56] References Cited

U.S. PATENT DOCUMENTS

| | | | |
|---|---|---|---|
| 667,367 | 2/1901 | Mitchell | 75/645 |
| 692,310 | 2/1902 | Knox | 75/645 |
| 3,081,163 | 3/1963 | Kuzell et al. | 75/643 |
| 3,725,044 | 4/1973 | Morisaki et al. | 75/74 |
| 3,807,716 | 4/1974 | Wegscheider | 266/143 |
| 3,901,489 | 8/1975 | Suzuki et al. | 266/171 |
| 5,180,422 | 1/1993 | Kikumoto et al. | 75/643 |
| 5,217,527 | 6/1993 | Goto et al. | 75/645 |

FOREIGN PATENT DOCUMENTS

| | | |
|---|---|---|
| 0487032A1 | 5/1992 | European Pat. Off. . |
| 4138094A1 | 5/1992 | Germany . |
| 2258246 | 2/1993 | United Kingdom . |

OTHER PUBLICATIONS

Mining Magazine, May 1973, London, GB, pp. 368–373, NN "Smelting at Harjavalta".

*Primary Examiner*—Scott Kastler

*Attorney, Agent, or Firm*—Oblon, Spivak, McClelland, Maier & Neustadt

[57] ABSTRACT

A copper smelting apparatus for processing of copper concentrates to produce blister copper requiring relatively low capital cost and land area. The apparatus combines batch smelting processing to produce copper matte with continuous processing to produce blister copper, and all the components of the facility are built above ground level. The apparatus includes a batch operated smelting furnace, a transport facility for transporting molten matte, and a continuous converting furnace for continuous production of blister copper by continuously receiving and processing the matte received from the transport facility. A holding container may be provided for temporarily holding the molten matte transported by the transport facility. The matte is delivered by gravity from the transport facility or the holding container to the continuous converting furnace through a first launder. The blister copper produced in the continuous converting furnace is delivered by gravity through a specified second launder to a specified refining furnace for the production of anode copper.

5 Claims, 5 Drawing Sheets

COPPER SMELTING APPARATUS

BACKGROUND OF THE INVENTION

1. Field of the Invention

The present invention relates to apparatuses for smelting sulfide copper concentrates to produce blister copper.

2. Discussion of the Background

Copper smelting facilities can be broadly divided into a continuous smelting process, for example a Mitsubishi process, and a batch process involving batch type smelting furnaces and converters.

The conventional batch processing will be explained with reference to FIG. 3 showing a facility configuration, and to FIG. 4 showing a process flow chart.

As shown in FIG. 3, the batch processing facility comprises: a flash smelting furnace 40 for producing a matte (containing a mixture of primarily copper sulfides and iron sulfides) and a slag (containing gangue minerals, fluxes and iron oxides) by melting finely divided and dried copper concentrates together with oxygen-enriched air or high temperature air stream to melt and oxidize; matte transport means 41 having a ladle 50 and a crane 51 for transporting the molten matte produced in the smelting furnace 40 to a converter 42 (to be described later); a batch operated converter 42, for example a Peirce Smith converter for making blister copper by further oxidizing the molten matte brought thereto by the matte transport means 41; a ladle 57 and a crane 59 for transporting the blister copper produced in the converter 42 to a refining furnace 44 (to be described later); and a plurality of refining furnaces 44 for making refined copper (anode copper) of higher copper grade. In FIG. 3, only one of the refining furnaces is shown.

The smelting furnace 40 has a furnace body 40*a*, and on the top section of the furnace body 40*a*, there are provided a charging nozzle 45*a* for admitting the copper concentrates, and inlet opening 45*b* for admitting oxygen-enriched air, fluxes, fuels and other raw materials into the smelting furnace 40. Reference numerals 46 and 47 respectively refer to a slag tapping hole and a matte tapping hole, and the matte tapping hole 47 is provided with a matte discharge pipe 48 having a valve 48*a*.

The matte transport means 41 has two support columns 49 (only one column being shown in FIG. 3) and a crane support section (drive section) 41*a*, the crane support section 41*a* being provided with a crane 51 which can suspend a ladle 50. The crane 51 is transported by the crane support section 41*a* and along the crane support section 41*a* between the flash smelting furnace 40 and the converters 42. The crane support section 41*a* is also provided with an additional crane 59 which can suspend a ladle 57.

The converter 42 is a batch type furnace, and the furnace body is provided with an inlet opening 53, which can be opened or closed with a lid member 53*a*. The reference numeral 54 refers to a slanting/rotation device.

The crane 59 moves between the converter 42 and the refining furnace 44 along the crane support section 41*a*.

The refining furnace 44 is provided with an inlet opening (not shown) at the top, and a discharge opening 63, and the inlet opening is opened or closed with a lid member 60. The reference numerals 61, 62 and 64 respectively refer to gas discharge opening, fuel burner and slanting/rotation device.

The process of smelting using this batch type facility will now be explained.

As shown in FIGS. 3 and 4, copper sulfide ores are processed first in a preparation facility 66 to carry out, for example, drying, sintering and pelletizing. The prepared copper concentrates are charged into the smelting furnace 40 through the charging nozzle 44 together with fuel and fluxes through the inlet opening 45 into the smelting furnace 40. The concentrates are melted in the smelting furnace 40, and the melt is separated by the density difference to an upper slag layer and a bottom matte layer. In the process, iron in the concentrates is oxidized, and combines with $SiO_2$ added as a flux to be included in the slag, and copper is concentrated in the matte as a molten sulfide. The matte containing copper as the primary ingredient is withdrawn from the matte discharge pipe 48 of the smelting furnace 40 into the ladle 50. The matte tapping step from the smelting furnace 40 in the smelting process is carried out in general as a batch process.

The ladle 50 is moved by the crane 51 to above the converter 42, and the molten matte in the ladle 50 is charged into the converter 42 through the inlet opening 53. The converter 42 is also charged with fluxes through the inlet opening and oxygen-enriched air is blown in through tuyers (not shown), and the copper sulfides in the matte are oxidized to produce blister copper. The blister copper produced in the converter 42 is withdrawn through the inlet opening 53, transferred to the ladle 57, transported by the crane 59, and charged into the refining furnace 44 through the inlet opening 60 disposed on the top section of the refining furnace 44. In the refining furnace 44, the blister copper is further refined to a higher grade copper, thus resulting in a refined copper.

The refined copper melt is withdrawn from the discharge hole 63, cast into copper anodes to be forwarded to an electrolytic refining tank 67 to produce electrolytic copper. Subsequently, the copper is melted in a reverberatory furnace, for example, and cast into billet cakes (refer to FIG. 4).

In the processes carried out in the smelting furnace 40 and the converter 42, the flue gases 70 generated contain a high percentage of sulphur dioxide gas, which is treated with water in a sulfuric plant 69 to produce sulfuric acid 71. Because the converter 42 operates on a batch system, the flue gas volume and the concentration of sulphur dioxide gas in the flue gas generated vary with time in a manner of square waves, i.e. high during the operational period and extremely low during tapping and discharging periods. It is therefore, necessary that the processing capacity of the sulfuric acid plant 69 be established to enable processing of the maximum volume of flue gas and the concentration of the sulphur dioxide gas in the flue gas.

In the conventional batch processing facility described above, because the acid plant processing capacity is geared to cope with the period of maximum production of flue gas and the concentration of sulphur dioxide in the flue gas, there is a problem that the capital cost for the acid plant becomes high.

Further, when a number of converters are provided to increase the production capability of blister copper, the number 8 peripheral facilities such as cranes must be increased and the attendant area for the added facility must also be provided. The overall result is a significant increase in the capital cost for the copper smelting.

The present inventors discovered that the above-noted problem can be resolved by replacing the bath processing converter with a continuous converting furnace for processing of copper matte to blister copper, because the continuous converting furnace produces relatively less flue gas compared with the batch type converter, and the volume of the flue gas generated and the concentration of sulphur dioxide in the flue gas is evenly spread over the operational period.

However, to enable to utilize a continuous converting furnace, the molten matte must be continuously charged into the continuous converting furnace. To do this, an elevational difference must be provided between the ground-level smelting furnace and the continuous converting furnace. For example, if the differential elevation is provided as shown in FIG. 5, by directly connecting the ground-level smelting furnace 40 with the continuous converting furnace 42*a* and the refining furnace 44 by means of launders 72, 73, the ground GL must be excavated to accommodate the continuous converting furnace 42*a* and the refining furnace 44. This approach ultimately requires vast facility modification expenses.

Another problem associated with the above launder connection approach is that, because the molten matte is withdrawn in batches, the flow of molten matte will be discontinuous, resulting in drying up of the launder and a high maintenance cost.

SUMMARY OF THE INVENTION

The present invention is presented to resolve the problems described above, and an objective is to present a copper smelting apparatus having a high production capacity requiring relatively low capital and maintenance cost requirements.

This objective is achieved in a copper smelting apparatus comprising: a batch operated matte smelting furnace for melting, oxidizing and smelting copper concentrates to produce and discharge a molten matte in batches; matte transport means for receiving and transporting the molten matte withdrawn in batches from the matte smelting furnace; a matte holding container provided for receiving the molten matte delivered in batches by the matte transport means, and temporarily holding batches of the molten matte discharged by the matte transport means; and a continuous converting furnace having a first launder attached thereto for continuously receiving the molten matte from the matte holding container, the continuous converting furnace being constructed to perform oxidation of the molten matte introduced through the first launder to continuously produce a blister copper melt, and having a second launder attached thereto for discharging the blister copper melt.

According to the apparatus presented above, preprocessed copper concentrates are charged into the matte smelting furnace together with fuel and fluxes, and the molten matte produced therein separates by density differences to an upper slag layer and a lower matte layer. The molten matte is withdrawn in batches in the matte transport means and is delivered in a batch of molten matte to the temporary holding container. From the holding container, the molten matte is continuously discharged through the first launder into the continuous converting furnace. The copper matte is further processed in the continuous converting furnace to produce a blister copper melt, which is discharged from the continuous converting furnace through the second launder to a refining furnace for the production of a high grade anode copper.

In the foregoing, the matte transport means may comprise: a ladle for receiving the molten matte withdrawn in batches from the matte smelting furnace; and a crane for transporting the ladle loaded with the molten matte to the matte holding container, discharging the molten matte into the matte holding container, and transporting an emptied ladle back to the matte smelting furnace. It is preferable that the matte holding container be a holding furnace. Furthermore, the copper smelting apparatus may further include a refining furnace for receiving the blister copper discharged from the second launder and refining the blister copper to produce an anode copper melt.

In another aspect of the invention, the copper smelting apparatus comprises: a batch operated matte smelting furnace for melting, oxidizing and smelting copper concentrates to produce and discharge a molten matte in batches; matte transport means for receiving and transporting the molten matte withdrawn in batches from the matte smelting furnace; and a continuous converting furnace having a first launder attached thereto for continuously receiving the molten matte transported by the matte transport means, the continuous converting furnace being constructed to perform oxidation of the molten matte to continuously produce a blister copper melt, and having a second launder attached thereto for discharging the blister copper melt.

In the foregoing, the matte transport means may comprises:

a plurality of ladles for receiving the molten matte withdrawn in batches from the matte smelting furnace; and a plurality of cranes for successively transporting loaded ladles to the first launder to discharge the molten matte in the first launder, and successively transporting emptied ladles back to the matte smelting furnace. Furthermore, the copper smelting apparatus may also include a refining furnace for receiving the blister copper discharged from the second launder and refining the blister copper to produce an anode copper melt.

According to the apparatus presented above, the molten matte holding container is not required. The molten matte is charged into the first launder directly from the matte transport means and the molten matte is processed as before in the continuous converting furnace and discharged into a refining furnace for the production of anode copper melt. As described above, the matte transport means may comprise a plurality of cranes to carry the loaded and emptied ladles between the matte smelting furnace and the entrance side of the first launder. The facility configuration is relatively simple, and the capital cost for the facility is lower while maintaining the same productivity as the facility having the molten matte holding container.

In either of the above two types of apparatuses, by conducting matte smelting and blister copper production operations in combined batch and continuous modes as described above, the production of a particularly high amount of flue gas from the blister copper operation is avoided. The flue gas production is smoothed out over the entire production period at an averaged level, rather than varying from an extreme high level to an extreme low level as in the conventional batch operation. Therefore, sulfuric acid production plant can be designed on the basis of a known averaged level of production of the flue gas, and the capital cost for copper smelting facility can be appropriated accordingly.

Furthermore, because the delivery of the molten matte is carried out at ground level, there is no need for providing an extensive excavation, and expenses associated with facility improvements as well as requirements for an extensive plant area are reduced.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Preferred embodiments of the invention will be explained in the following with reference to the drawings.

Figure 1:
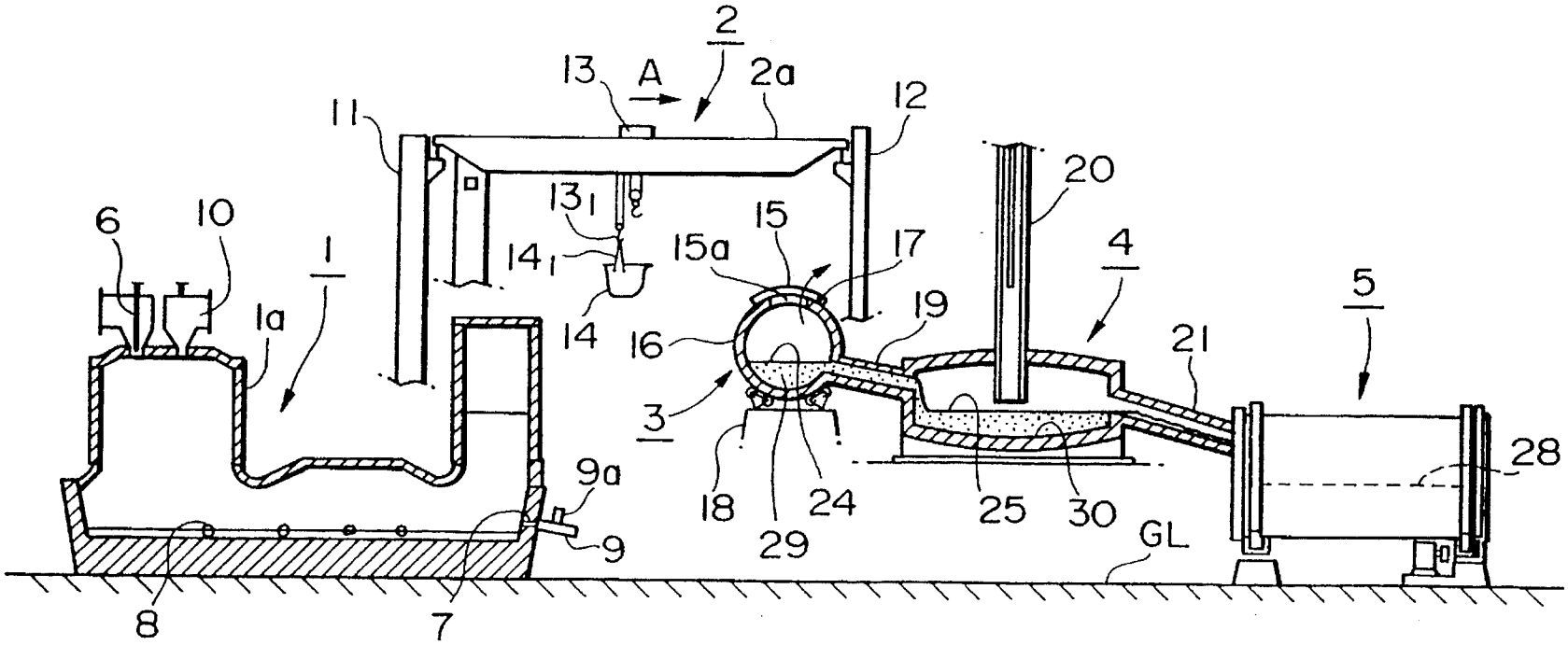
FIG. 1 is a schematic cross-sectional view showing a copper smelting apparatus in accordance with a first embodiment of the present invent ion.

As shown in FIG. 1, the batch type copper smelting apparatus or facility in accordance with a first embodiment comprises: a matte smelting furnace 1 for producing a matte (containing a mixture of primarily copper sulfides and iron sulfides) and a slag (containing gangue minerals, fluxes and iron oxides) by melting finely divided and dried copper concentrates together with oxygen-enriched air or high temperature air stream to melt and oxidize; a matte transporter 2 having a ladle 14 and a crane 13 for transporting the molten matte produced in the matte smelting furnace 1 to the holding furnace 3 (to be described later); a holding furnace 3 serving as a holding container or vessel for temporary storage of the molten matte; a continuous converting furnace 4 for producing blister copper by oxidizing the molten matte which is delivered from the holding furnace 3 through a first launder 19; a second launder 21 for transporting the blister copper produced in the continuous converting furnace 4 to a refining furnace 5 (to be described later); and a plurality of refining furnaces 5 for making higher grade refined copper (anode copper) from the blister copper transported through the second launder 21. In FIG. 1, only one refining furnace 5 is shown.

The matte smelting furnace 1 includes a furnace body 1*a* having a charging nozzle 6 for charging copper concentrates, and an inlet opening 10 for admitting oxygen-enriched air, fluxes, fuel and other raw materials into the matte smelting furnace 1. Reference numerals 8, 7 refer respectively to a slag tapping hole and a matte tapping hole, and the matte tapping hole 7 is provided with a matte discharge pipe 9 having a valve 9*a*. Conventional flash smelting furnaces, reverberatory furnaces or electric furnaces are suitable for use as the matte smelting furnace 1.

The matte transporter means 2 comprises: the ladle 14 having a handle $\mathbf{14}_1$; a crane support section (driving section) 2*a* disposed near the matte smelting furnace 1 and supported by support columns 11, 12. The crane support section 2*a* is provided with a crane 13 which suspends the ladle 14. The ladle 14 is suspended on a hook $\mathbf{13}_1$ of the crane 13 by means of the handle $\mathbf{14}_1$. The crane 13 is transported by the crane support section 2*a* along the crane support section 2*a* between the matte smelting furnace 1 and the entrance side of the first launder 19 (left side in FIG. 1).

The holding furnace 3 is disposed on a base frame 18, and is provided with heating means (not shown), such as burners, and an inlet opening 15*a* at the top of the furnace body 16. The inlet opening 15*a* is opened or closed in the direction of the arrow by means of a hinge 17 attached to a lid member 15. An outlet opening (not shown) is provided at the bottom of the furnace body 16. The outlet opening is connected to the entrance side of the first launder 19 (to be described later).

The continuous converting furnace 4 is basically the same as the continuous converting furnace in the known Mitsubishi process of continuous copper smelting. The continuous converting furnace 4 is disposed below the holding furnace 3, and is provided with a double walled lance 20, which is freely movable in the vertical direction, through the ceiling section of the furnace body. The lance 20 is used to deliver oxygen-enriched air, fluxes and cooling media to the furnace interior.

The continuous converting furnace 4 and the holding furnace 3 are connected by means of the first launder 19 for gravity feeding of molten matte, and the molten matte from the holding furnace 3 is delivered to the continuous converting furnace 4 through the first launder 19. The liquid surface 24 of the molten matte 29 in the holding furnace 3 is elevated with respect to the liquid surface 25 of the molten matte 30 in the continuous converting furnace 4.

The refining furnace 5 receives blister copper produced in the continuous converting furnace 4 via the second launder 21 for refining of the blister copper to produce higher grade copper. The refining furnace 5 is disposed at the ground level GL, and the liquid surface 28 of the blister copper in the refining furnace 5 is at a lower elevation than the liquid surface 25 of the molten matte 30 in the continuous converting furnace 4. There are a plurality of refining furnaces 5, and each refining furnace 5 is connected to the continuous converting furnace 4 through its own second launder 21. A switching valve (not shown) is used to select a second launder 21 as required to deliver the blister copper to an appropriate refining furnace.

Next, the smelting process using the batch apparatus of the present invention will be explained.

Sulfide ores are processed in a preparation facility (not shown) to perform drying, sintering and pelletizing operations, and the prepared copper concentrates are charged into the matte smelting furnace 1 through the charging nozzle 6, together with the fuel and fluxes through the inlet opening 10. The charge is melted in the matte smelting furnace 1, and is separated into an upper slag layer and a lower matte layer. In effect, iron in the ore is oxidized and combines with $SiO_2$ added to flux the iron oxide to form a slag, and copper becomes concentrated in the matte as molten sulfides. The molten matte is periodically withdrawn from the batch operated smelting furnace 1 through the discharge pipe 9 to the ladle 14.

The ladle 14 is transported in the direction of the arrow A towards the holding furnace 3 by means of the crane 13, and when the ladle reaches above the holding furnace 3, the ladle 14 is tipped to pour the molten matte through the inlet opening 15*a* for temporary storage of the molten matte in the holding furnace 3. The molten matte is delivered to the continuous converting furnace 4 through the first launder 19, and is treated with oxygen-enriched air and fluxes supplied through the lance 20 for selective oxidation and removal of copper sulfides followed by sulphur in the matte to produce blister copper. The emptied ladle 14 is moved back towards the matte smelting furnace 1 by the crane 13 to receive another load of molten matte, and this process is repeated.

The blister copper produced continuously in the continuous converting furnace 4 is continuously discharged into a specified refining furnace 5 through a specified second launder 21. This procedure is a significant improvement in the productivity of high grade copper. In the refining furnace 5, the blister copper is further oxidized and then reduced to yield a higher grade copper to be cast into anodes. The process involves an oxidation step of blister copper to remove impurities, followed by reduction with natural gas and/or ammonia.

In the above embodiment, the flue gas from the continuous converting furnace 4 containing high concentrations of sulphur dioxide is treated in the sulfuric acid plant by absorbing the gas in water to produce sulfuric acid. Because the generation of the flue gas is continuous from the continuous converting furnace 4, the generation of flue gas and the concentration of sulphur dioxide in the flue gas are smoothed out over the processing period compared with those from the batch operated converter which has high periods and low periods of flue gas generation. Therefore, the flue gas emitted from the continuously operated converting furnace can be treated in an acid plant having a much smaller capacity than that required for the batch operated converter. The process of the present invention is also adaptable to increasing the production capacity. If it is required to increase the output of the refined copper, a small additional capacity sulfuric acid plant would be adequate, thus minimizing the capital cost as well as saving facility spaces for ancillary facilities such as cranes. Furthermore, the existing crane can be used to transport molten matte to the holding furnace 3, and there is no need to excavate the ground GL to house additional facilities because the liquid surfaces 24, 25 and 28 can be positioned by appropriately choosing the relative positioning of the holding furnace 3, the continuous converting furnace 4, and the refining furnace 5.

In the above embodiment, a holding furnace is used as a holding container, but to save capital cost, it is permissible to use a simple container such as a kettle.

Figure 2:
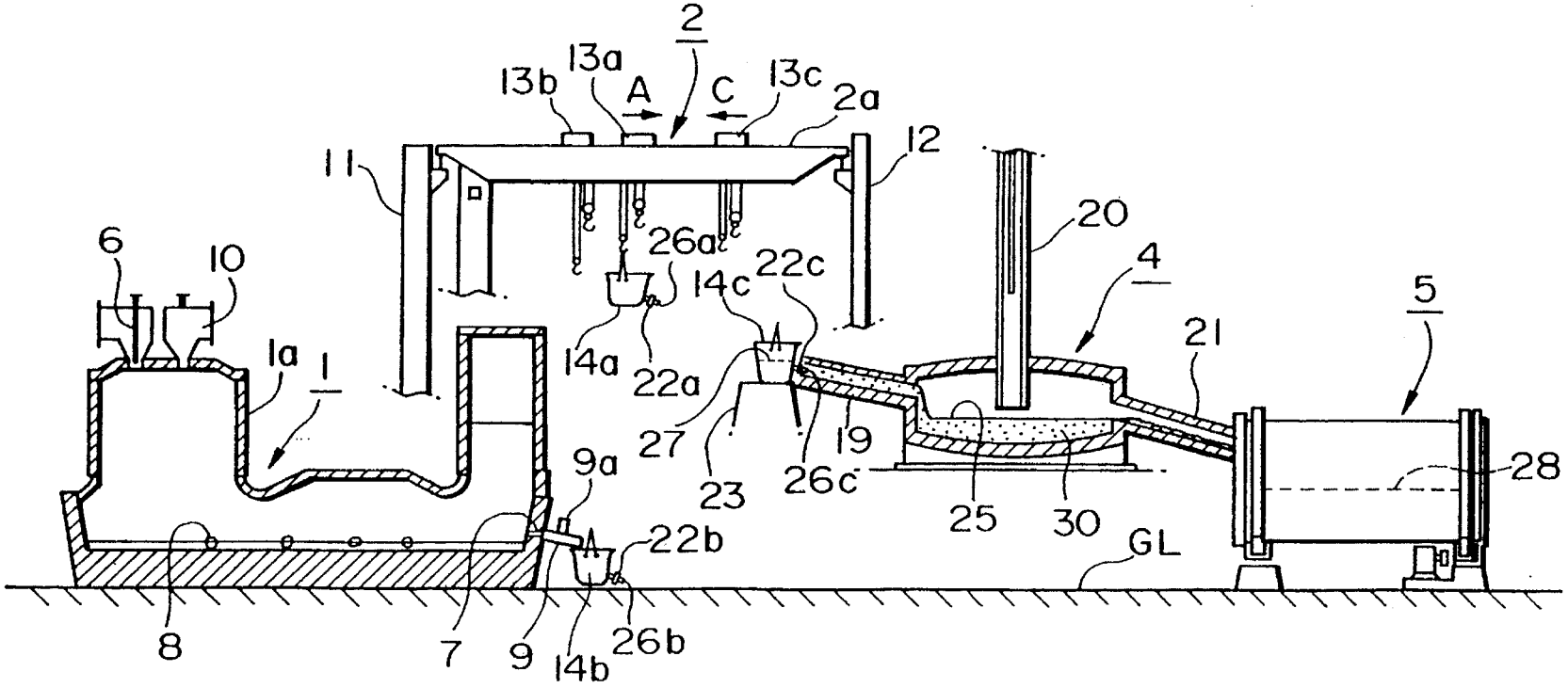
FIG. 2 is a view similar to FIG. 1, but showing a copper smelting apparatus in accordance with a second embodiment of the present invention.
Figure 3:
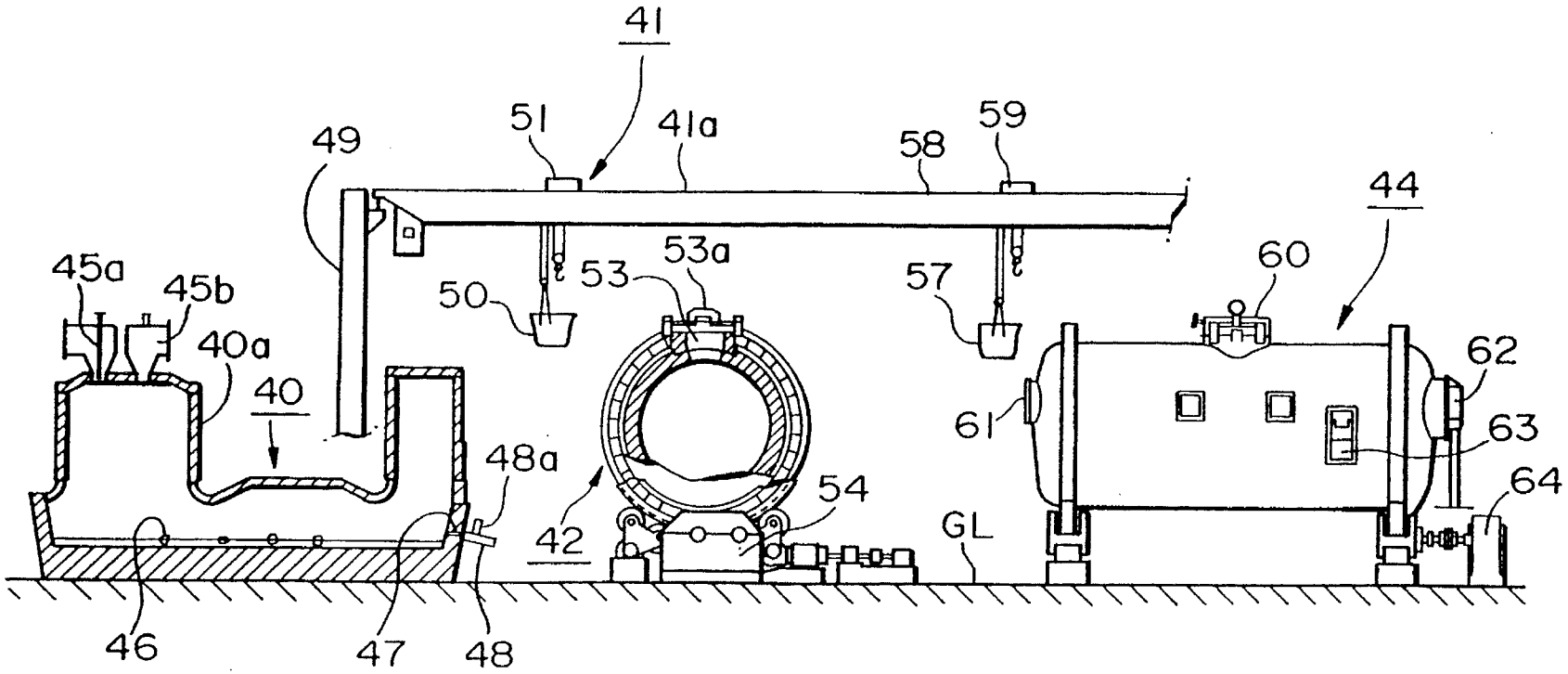
FIG. 3 (PRIOR ART)
FIG. 3 is a view similar to FIG. 1, but showing a conventional copper smelting apparatus.
Figure 4:
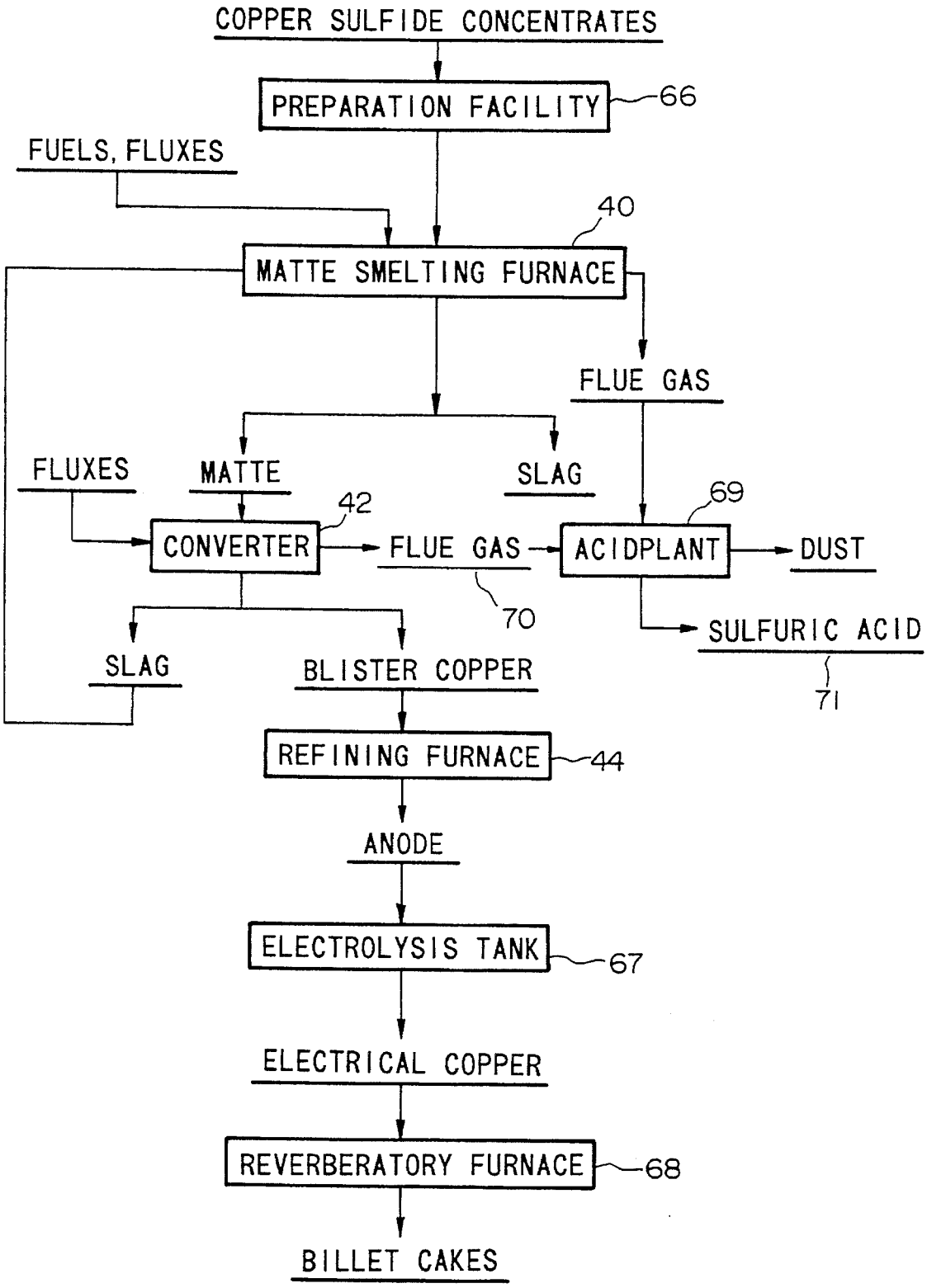
FIG. 4 is a flow chart for explaining the copper smelting process.
Figure 5:
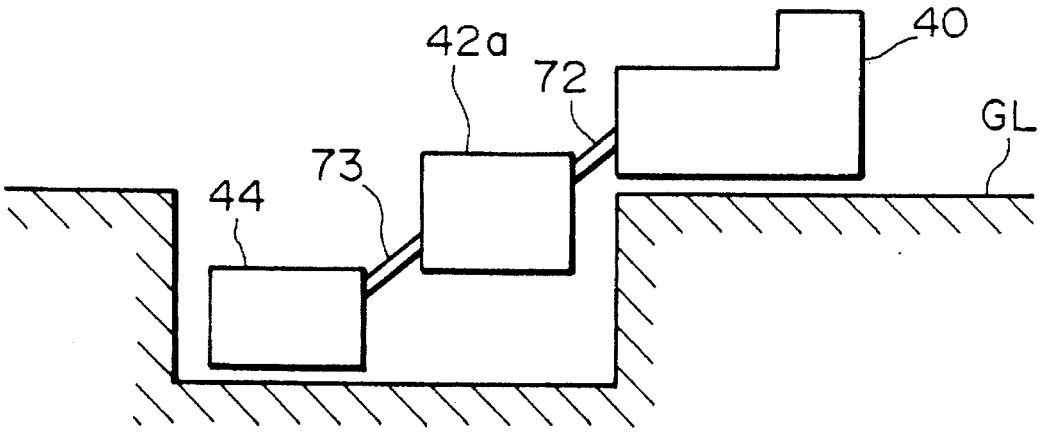
FIG. 5 (PRIOR ART)
FIG. 5 is a schematic representation of another conventional copper smelting apparatus.

Next, a second embodiment will be presented, but the explanation is focused on the points of difference between the first and the second embodiments. FIG. 2 illustrates the second embodiment, and in this figure, the same reference numerals are used for the same components, and their explanations are mostly omitted.

As shown in FIG. 2, the matte transporter means 2 for molten matte is disposed near the matte smelting furnace 1, and includes the support columns 11, 12 and the crane support section 2*a* supported by the support columns 11, 12 as in the first embodiment. However, the crane support section 2*a* is provided with three cranes 13*a*, 13*b* and 13*c* for suspending ladles 14*a*, 14*b* and 14*c*. The cranes 13*a*, 13*b* and 13*c* are moved independently of each other by the crane support section 2*a* along the crane support section 2*a* between the matte smelting furnace 1 and the entrance side of the first launder 19.

A base frame 23 is disposed in the vicinity of the first launder 19 of the matte smelting furnace 1. Each side wall of the ladles 14*a*, 14*b* and 14*c* is provided with a discharge pipe 26*a*, 26*b*, 26*c* each having a valve 22*a*, 22*b*, 22*c*. By opening the valves 22*a*, 22*b* and 22*c* as appropriate, the molten matte in the ladles 14*a*, 14*b* and 14*c* can be discharged into the first launder 19 through the discharge pipes 26*a*, 26*b* and 26*c*.

The points of difference in the smelting process of the second embodiment from the first embodiment are now explained.

The molten matte is withdrawn from the matte smelting furnace 1 through the discharge pipe 9 of the furnace body 1*a*, and is transported in the ladle 14*a*. The ladle 14*a* is transported in the direction of the arrow A by the crane 13*a* towards the base frame 23.

In the meantime, the ladle 14*c* preceding the ladle 14*a* is already on the base frame 23, and the valve 22*c* is opened to discharge the molten matte from the ladle 14*c* into the first launder 19 through the discharge pipe 26*c*. After completion of the discharging step, the ladle 14*c* is returned by the crane 13*c* to the matte smelting furnace 1 in the direction of the arrow C to receive another charge of molten matte. The ladle 14*b* following the ladle 14*a* receives molten matte from the discharge pipe 9 of the matte smelting furnace 1, and is transported towards the base frame 23 by the crane 13*b*.

In this embodiment, three ladles 14*a*, 14*b* and 14*c* operate in turn to deliver molten matte through the first launder 19 to the continuous converting furnace 4. Compared with the first embodiment, the expensive holding furnace is not required, and the capital cost can be further reduced. The ladles 14*a*, 14*b* and 14*c* can be provided with lids to improve thermal insulation and maintain the quality of the molten matte.

Obviously, many modifications and variations of the present invention are possible in the light of the above teachings. It is therefore to be understood that within the scope of the appended claims, the invention may be practiced otherwise than as specifically described.

Finally, the present application claims the priority of Japanese Patent Application No. 6-122887, which is herein incorporated by reference.

What is claimed is:

1. A copper smelting apparatus, which comprises:

a batch operated matte smelting furnace, said smelting furnace melting, oxidizing and smelting copper concentrates to produce and discharge a molten matte in batches;

a matte transporter receiving and transporting the molten matte withdrawn in batches from a lower portion of said matte smelting furnace; and a continuous converting furnace having a first launder attached thereto, said first launder continuously receiving the molten matte transported by said matte transporter, said continuous converting furnace performing oxidation of the molten matte introduced through said first launder to continuously produce a blister copper melt, and having a second launder attached thereto, said second launder discharging the blister copper melt;

a matte holding container having an upper inlet opening at a top portion thereof, said matte holding container receiving and temporarily holding the molten matte transported in batches by said matte transporter, said first launder being connected to said matte molding container and continuously introducing molten matte into said continuous converting furnace wherein said matte transporter comprises:

a ladle receiving the molten matte withdrawn in batches from said matte smelting furnace; and a crane transporting said ladle loaded with the molten matte to said matte holding container, discharging the molten matte from said ladle into said inlet opening of said matte holding container, and transporting said ladle back to said matte smelting furnace.

2. A copper smelting apparatus, which comprises:

a batch operated matte smelting furnace, said smelting furnace melting, oxidizing and smelting copper concentrates to produce and discharge a molten matte in batches;

a matte transporter receiving and transporting the molten matte withdrawn in batches from a lower portion of said matte smelting furnace;

a continuous converting furnace having a first launder attached thereto, said first launder continuously receiving the molten matte transported by said matte transporter, said continuous converting furnace performing oxidation of the molten matte introduced through said first launder to continuously produce a blister copper melt, and having a second launder attached thereto, said second launder discharging the blister copper melt; and a matte holding container, said matte holding container receiving and temporally holding the molten matte transported in batches by said matte transporter, said first launder being connected to said matte molding container and continuously introducing molten matte into said continuous converting furnace wherein said matte transporter comprises:

a plurality of ladles receiving the molten matte withdrawn in batches from said matte smelting furnace, said ladles each having a discharge pipe and a valve;

a plurality of cranes successively transporting the ladles after being loaded with the molten matte to said first launder to discharge the molten matte into said first launder, through said discharge pipe of each of said ladles, and successively transporting said ladles back to said matte smelting furnace.

3. A copper smelting apparatus as defined in claim 1, further comprising a refining furnace receiving the blister copper discharged from said second launder and refining the blister copper to produce an anode copper melt.

4. A copper smelting apparatus as defined in claim 1, further comprising a refining furnace receiving the blister copper discharged from said second launder and refining the blister copper to produce an anode copper melt.

5. A copper smelting apparatus as defined in claim 2, further comprising a refining furnace receiving the blister copper discharged from said second launder and refining the blister copper to produce an anode copper melt.

* * * * *